US005305489A

United States Patent [19]

Lage

[11] Patent Number: 5,305,489

[45] Date of Patent: Apr. 26, 1994

[54] ERGONOMIC TOPOGRAPHIC TOOTHBRUSH

[76] Inventor: Gregg L. Lage, 1680 Peregrine Ct., Broomfield, Colo. 80020

[21] Appl. No.: 46,445

[22] Filed: Apr. 13, 1993

Related U.S. Application Data

[63] Continuation-in-part of Ser. No. 739,727, Jul. 30, 1991, abandoned, which is a continuation of Ser. No. 573,893, Aug. 28, 1990, abandoned.

[51] Int. Cl.[5] ..... A46B 9/04

[52] U.S. Cl. ..... 15/167.1; 15/143.1; 15/207.2; 15/DIG. 5; D4/104

[58] Field of Search ..... 15/207.2, 143.1, 167.1, 15/167.2, 172, 176.1, DIG. 5; D4/104, 112

[56] References Cited

U.S. PATENT DOCUMENTS

| | | | |
|---|---|---|---|
| 74,560 | 2/1868 | Maury | 15/167.1 |
| 803,995 | 11/1905 | Davenport | 15/167.1 |
| 958,371 | 5/1910 | Danek | 15/167.1 |
| 1,369,966 | 3/1921 | Cosens et al. | 15/167.1 |
| 2,040,245 | 5/1936 | Crawford | 15/167.1 |
| 2,043,898 | 6/1936 | Malcolm | 15/167.1 |
| 2,056,447 | 10/1936 | Fell | 15/167.1 |
| 2,066,068 | 12/1936 | Cooke | 15/167.1 |
| 2,094,240 | 9/1937 | Herrick et al. | 15/167.1 |
| 2,154,352 | 4/1939 | Peterson | 15/167.1 |
| 2,186,005 | 1/1940 | Casto | 15/167.1 |
| 2,263,885 | 11/1941 | McGauley | 15/143.1 |
| 2,360,745 | 10/1944 | Vogel | 15/167.1 |
| 2,414,775 | 1/1947 | Stavely | 15/143.1 |
| 3,792,504 | 2/1974 | Smith | 15/167.1 |
| 4,109,339 | 8/1978 | Dietrich | 15/167.1 |
| 4,592,109 | 6/1986 | Borea | 15/172 |

FOREIGN PATENT DOCUMENTS

| | | | |
|---|---|---|---|
| 2728672 | 1/1979 | Fed. Rep. of Germany | 15/167.1 |
| 695325 | 9/1930 | France | 15/167.1 |
| 835142 | 9/1938 | France | 15/167.1 |
| 81229 | 8/1934 | Sweden | 15/167.1 |

*Primary Examiner*—Stephen F. Gerrity
*Assistant Examiner*—Mark Spisich
*Attorney, Agent, or Firm*—Frank P. Grassler

[57] ABSTRACT

A toothbrush having a handle rotated by forty five degrees with respect to its detachable and replaceable bristle head, whose bristles form a contoured brushing surface having three to four alternating rounded peaks and valleys, and which has a raised helical screw thread on its neck that allows a twirling motion at the neck to impart a diagonal direction of travel to the bristles of the brush.

2 Claims, 3 Drawing Sheets

Fig. 7
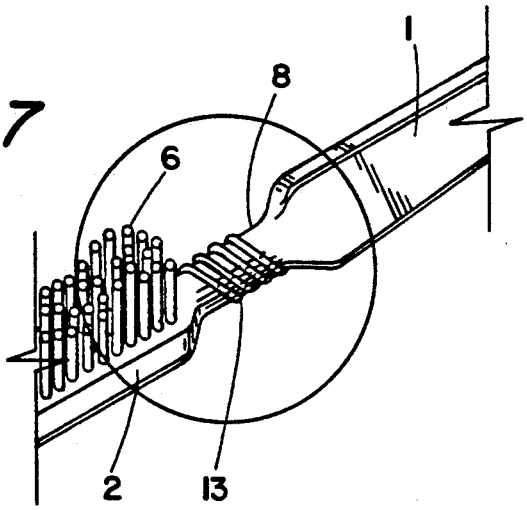
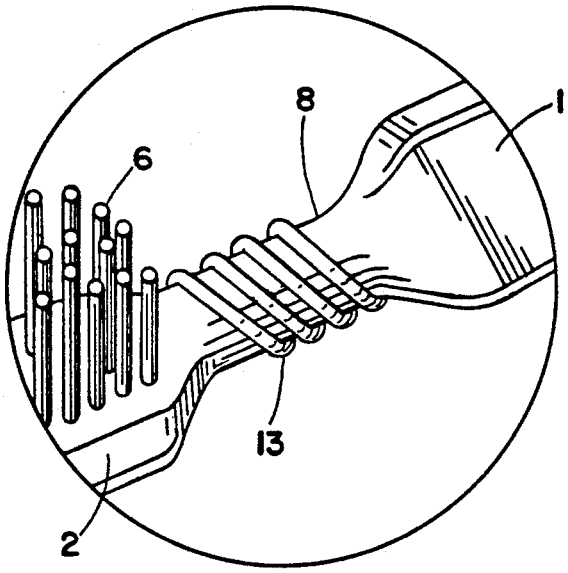
Fig. 8
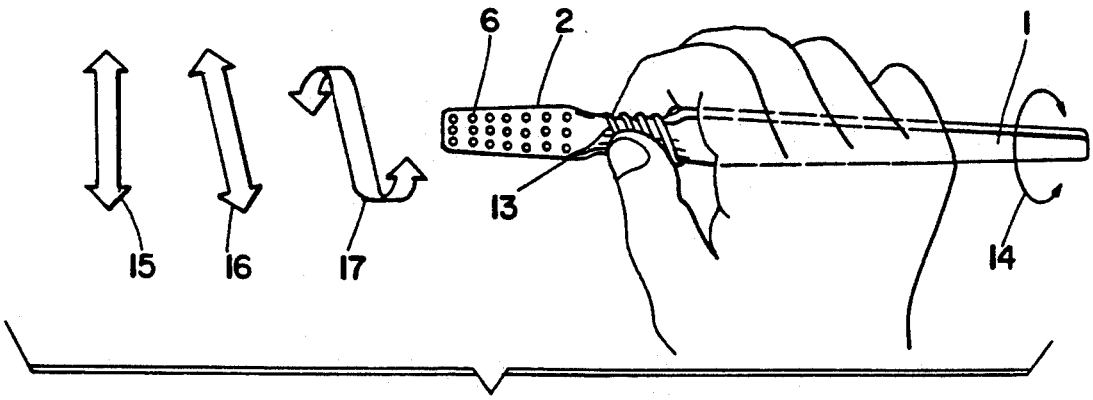
Fig. 9

ERGONOMIC TOPOGRAPHIC TOOTHBRUSH

RELATED APPLICATIONS

This application is a continuation-in-part of application Ser. No. 739,727, filed Jul. 30, 1991, now abandoned, which was a continuation of application Ser. No. 573,893, filed Aug. 28, 1990, now abandoned.

SUMMARY OF THE INVENTION

The present invention relates to toothbrushes in general and in particular relates to a toothbrush that has an ergonomic handle, a topographically surfaced bristle face and a helical means for producing brushing action in diagonal directions in addition to motion in to-and-fro or up-and-down directions.

BACKGROUND OF THE INVENTION

Modem correct dental hygiene practice requires that a patient not only brush their teeth three times daily, but also that a certain specific technique be used. A patient must direct the ends of the toothbrush bristles at approximately a forty five degree angle to the bite plane (which is an imaginary plane that passes between the upper and lower jaws and is parallel to the surface of the earth when a human is standing), and brush back and forth in short, almost vibratory strokes. If the patient brushes back and forth in a long, gliding motion, rather than a short, vibratory motion, the patient risks notching the enamel at the roots of the teeth over long periods of time. Also, if the forty five degree angle of the bristle ends to the bite plane in not maintained, plaque removal is incomplete and inefficient. Incomplete plaque removal poses the threat of gum disease to the patient, which is now a much greater problem than caries prevention.

Even with instructions and demonstrations by their dentists and dental hygienists, a majority of dental patients will not use the correct technique described above. This incidence of patient non-compliance is likely due to the necessity for the patient to make a conscious effort to think about the mechanics of correctly holding the toothbrush, which is a thought process easily forgotten during the rather dull tedium of brushing one's teeth. Moreover, non-compliance may also be attributed to the unnatural feel of holding a conventional toothbrush handle in the hand at an angle of forty five degrees. The most comfortable way to hold the human hand in front of the head while grasping an elongate object results in conventional toothbrush handles being held at about a five to ten degree angle to the bite plane. To tilt the handle to the extent needed to achieve a forty five degree angle requires an unnatural-feeling twist of the forearm. Therefore, it is one object of the present invention to provide a novel toothbrush that directs the bristle face to the bite plane at approximately a forty five degree angle while being held in the hand in a natural, comfortable way and which eliminates the necessity for the patient to consciously think about correct holding techinique.

Another consideration in this area is that the accumulation of plaque at and slightly beneath the gumline must be completely and efficiently removed, while affording a certain degree of comfort to the patient. Conventional toothbrush bristle heads that are substantially flat suffer from the problem of trying to cover contoured surfaces of the teeth with a flat, planar surface of bristle ends. Bristle dispersement is not even, a snug fit of bristle ends against the teeth is not achieved, and more effort than is necessary must be expended by the patient to remove the plaque. Many past inventions in this area have attempted to come up with a bristle head face that does not present a flat, planar surface to the teeth and gums. Most prior designs suffer from the design defect of having a conical or ridge-like projection somewhere on their bristle face. Since the gums are among the most touch-sensitive tissues in the body, such conical or ridge-like surfaces are likely to cause needless discomfort to the patient who is careful to brush at the gumline, in effect penalizing them for their attention to technique. Therefore, it is another object of the present invention to provide a toothbrush that permits close-fitting, intimate contact with the curved surfaces of the teeth while not causing needless discomfort to the patient using it. A closely related object of the present invention is to provide a novel toothbrush whose bristle head face has alternating concavities and convexities that are designed to intimately follow the alternating curved surfaces of the teeth themselves.

Another object of the present invention is to provide a toothbrush that can be attached to an electrical means for creating a rapid, reciprocal motion of the brush against the teeth.

Still another object of the present invention is to provide a toothbrush that can be rotated about the axis of the longitudinal plane of the handle, to any angle deemed to be advantageous, and to be equally maneuverable by either right-handed or left-handed users.

A preferred embodiment of the manual version of the present invention has the objective of offering the user an additional direction of bristle face motion not presently available by toothbrushes of the prior art. This motion is in diagonal directions, rather that up-and-down or to-and-fro directions.

BRIEF DESCRIPTION OF THE DRAWINGS

FIG. 7 is a perspective view a preferred embodiment of the toothbrush of the present invention, not to scale, showing a preferred degree of axial rotation of the bristle head with respect to the handle's longitudinal plane, and showing helical threads that are raised upon the surface of the neck of the toothbrush.

FIG. 8 is an enlargement of the circled area of FIG. 7, showing in greater detail the raised helical threads on the neck of the toothbrush.

FIG. 9 Is a frontal elevation showing how a user would hold the toothbrush of the invention. The drawing of the user holding the toothbrush is accompanied by three dual headed arrows to aid in illustrating the directions of motion of the bristle face of the toothbrush.

SUMMARY OF THE INVENTION

Figure 1:
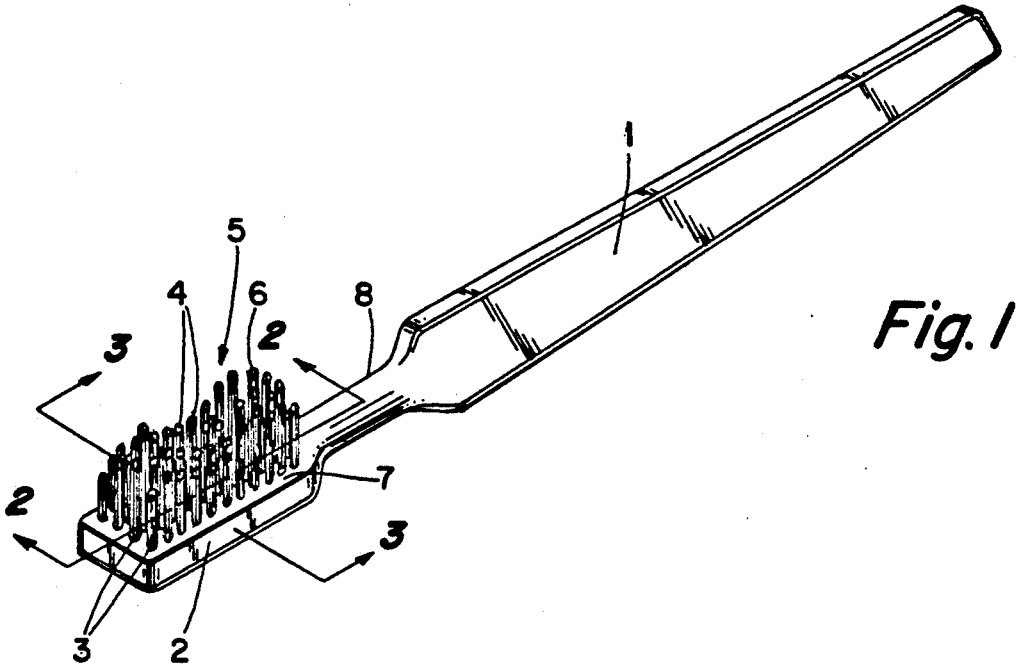
FIG. 1 is a perspective view of the toothbrush of the present invention, not to scale, showing one embodiment of a preferred layout of the contours of its bristle head face and a preferred degree of axial rotation of the bristle head with respect to the handle's longitudinal plane.

The invention is a toothbrush having a handle, an integral brush head and a neck connecting said handle to said brush head, said brush head having a longitudinal and a transverse axis with respect to said handle, and which brush head anchors a plurality of bristles having tips, the tips forming a bristle face These elements comprise:(a) a plurality of tufts of bristles, the tips of said bristles disposed so as to form in said bristle face an alternating series of first and second substantially arctuatecurves; (b) said first curves being substantially convexly arctuate in the longitudinal and transverse axes of said brush head; (c) said second curves being substantially concavely arctuate in the longitudinal axis of said brush head and substantially convexly arctuate in the transverse axis of said brush head; (d) said first and second curves defining a regular and repeating pattern having substantially equal heights and substantially equal depths; and(e) said neck having on its surface means for enabling a user of said toothbrush to obtain bristle face motion along a diagonal line by twirling said neck between a thumb and index finger. The means for enabling a user to obtain bristle face motion along a diagonal line comprises a plurality of helically wound threads of predetermined thread height and predetermined pitch.

A most preferred embodiment of the invention comprises a toothbrush having an elongated handle, an integral brush head and a neck connecting said handle to said brush head, said head, neck and handle all being coaxial, said brush head having a longitudinal and a transverse axis with respect to said handle, and which brush head anchors a plurality of bristle tufts having free ends spaced from the head, comprising a plurality of substantially parallel tufts of bristles, said tufts of varying predetermined heights juxtaposed in close proximity to each other, the tips of said bristles disposed so as to form a bristle face defining alternating series of first and second substantially arctuate curves, said first curves being substantially convexly arctuate in the longitudinal and transverse axes of said brush head, said second curves being substantially concavely arctuate in the longitudinal axis of said brush head and substantially convexly arctuate in the transverse axis of said brush head, said handle fixedly attached via said neck to, and axially rotated with respect to the longitudinal axis of, said brush head, said first and second curves defining a regular and repeating pattern having substantially equal heights and substantially equal depths, said neck being substantially cylindrical, and said neck furthermore being substantially narrower in dimension than said handle and said brush head, said neck having on its surface a plurality of helically wound threads of predetermined thread height and predetermined pitch and which threads are of substantially the same radial distance from said longitudinal axis and which threads comprise means for enabling a user of said toothbrush to obtain bristle face motion along a line diagonal with respect to said longitudinal axis by twirling said neck between a thumb and index finger.

DETAILED DESCRIPTION OF THE PREFERRED EMBODIMENTS

Turning first to FIG. 1, there is shown in perspective view one preferred embodiment of the toothbrush of the present invention with a typical handle I and the brush body means 2, in which there are anchored a large number of tufts 3 of bristles 4. The handle and brush body means can be made of any resilient material, but most preferably and conveniently will be made of a thermoplastic material that has been injection molded in one piece or in two pieces that are to be joined fixably or rotatably at neck area 8. The bristles 4 are inserted and molded into the brush body means 2 by methods well known to those of ordinary skill in the brush making art. Bristles may be of natural origin or made of any suitable thermoplastic material, preferably nylon. Bristles may be inserted and retained in previously molded holes by well known means and the shaping of the ends of the bristles into their preferred curvitures made before or after the bristles are bonded into said brush body means according to means well known to those of ordinary skill in the art. Alternatively, tufts may be installed by center folding of a single long length bristle into a sharp bend and forcing a plurality of such folded bristles into a premolded hole in the brush body means 2. Commonly, tufts will include ten to twenty four bristles of 0.0065 to 0.015 inches in diameter. The tufts will be in relatively close proximity to each other, without substantial gaps between themselves.

The bristles 4 collectively form the bristle face 5. In the perspective view of FIG. 1, the bristle face 5 is seen to form a surface of bristle ends that will contact teeth and gums during use, which bristle face 5 has hemispheres and valley-like concavities that resemble a topographic surface, which term is used here in the sense of a surface that defines a variety of heights and depths relative to a base plane. The number of hemishpheres 6 can be two, three, four or more, but in the more preferred embodiments there will be three in the pediatric embodiment and four in the adult embodiment. This topographic surface is created by using predetermined heights of the bristles in varying heights, rising and falling in predetermined curve patterns. The various heights of the bristle are acheived by methods well known to those of ordinary skill in the brush-making art. It can be seen that the hemispheres 6 and concavities 7 are of smooth curviture, free of points or planar surfaces. This is important since such smooth curviture surfaces will result in more effective cleaning and will minimize discomfort to the user. Preferably, the hemispheres 6 are of substantially spherical to eliptical curviture, as are the concavities 7. Most preferably, the hemispheres 6 and concavities 7 are substantially spherical.

Figure 2:
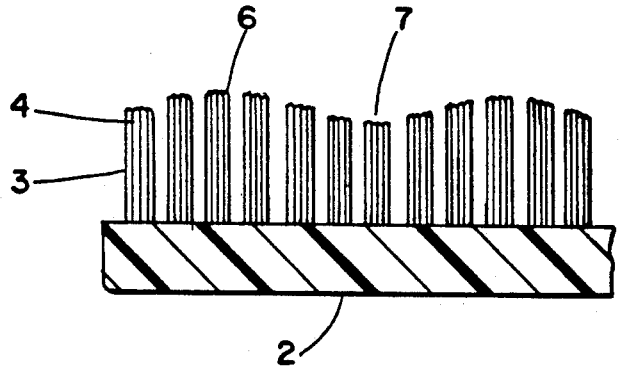
FIG. 2 is a cross sectional side elevation taken along line 2—2 of FIG. 1.

Turning to FIG. 2, there is seen is side view along line 2—2 of FIG. 1 an alternating series of convexities and concavities that in a more preferable embodiment of the present invention are substantially circular to elliptical.

Figure 3:
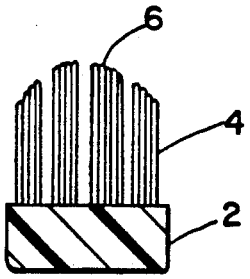
FIG. 3 is a cross sectional end elevation taken along line 3—3 of FIG. 1.

Turning to FIG. 3, it is seen in cross-sectional view along line 3—3 of FIG. 1 that the hemispherical high points of the bristle face 5 form a single substantially convex profile and, more preferably, a substantially spherical to elliptical convex profile.

Figure 4:
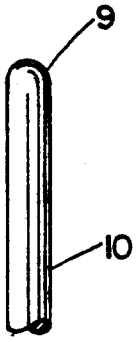
FIG. 4 is a side elevation, not to scale, of one preferred embodiment of the bristle tips of the toothbrush of the invention.
Figure 5:
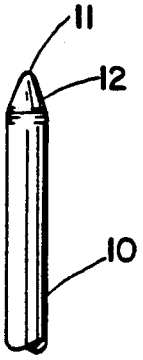
FIG. 5 is a side elevation, not to scale, of another preferred embodiment of the bristle tips of the toothbrush of the invention.

At FIG. 4 there is seen in side view one preferred bristle tip shape, being substantially rounded hemispherically 9 at the top of the shaft of the bristle 10. At FIG.

5 there is seen another preferred bristle tip shape, which is substantially rounded hemispherically 11, but at the top of a conical taper 12 that in turn is at the top of the shaft of the bristle 10.

Returning to FIG. 1, it is seen at 8 that the brush body means 2 is axially rotated with respect to the longitudinal plane of handle 1. The degree of rotation need not be precisely any given amount, but is preferably from thirty to sixty degrees, more preferably from thirty five to fifty five degrees, and most preferably forty five degrees. The degree of rotation can be either clockwise or counterclockwise, and the handle can be of any shape, but the most preferred embodiment will include a substantially flat, planar surface of the handle 1 for either a right-handed or a left-handed user to grasp a reference surface that will cause the bristles of the toothbrush to tilt upward without significant rotation of the patient's forearm. In one alternative embodiment of the present invention there is at neck 8 a variable rotation means that would allow the brush body means to be set by the patient at a variety of desired angles to the handle plane and locked in place. This is accomplished by, for example, molding a male substantially tubular plug designed to fit snugly into a female receptacle. Furthermore, a ratcheting means can be added or alliteratively, the male plug and female receptacle can be longitudinally grooved to provide fixed position after degree of rotation is selected. It will be appreciated and readily apparent that this feature also means that the brush body means is changeable at will by the patient, giving the patient the option to acquire new brush body means for easy replacement as the old brush body means wears out. This is becoming increasingly important as dental research establishes ever-shorter recommended periods between replacing toothbrushes. The patient would simply acquire multiple disposable or sterilizeable brush body means while keeping one permanent material. Various materials contemplated for this purpose include thermoplastic and thermosetting resins and stainless steel. Additionally, in yet another embodiment of the present invention, the brush body means can be fixedly attached to an electrical means for causing the brush to reciprocate in a rapid, rhythmic fashion.

Figure 6:
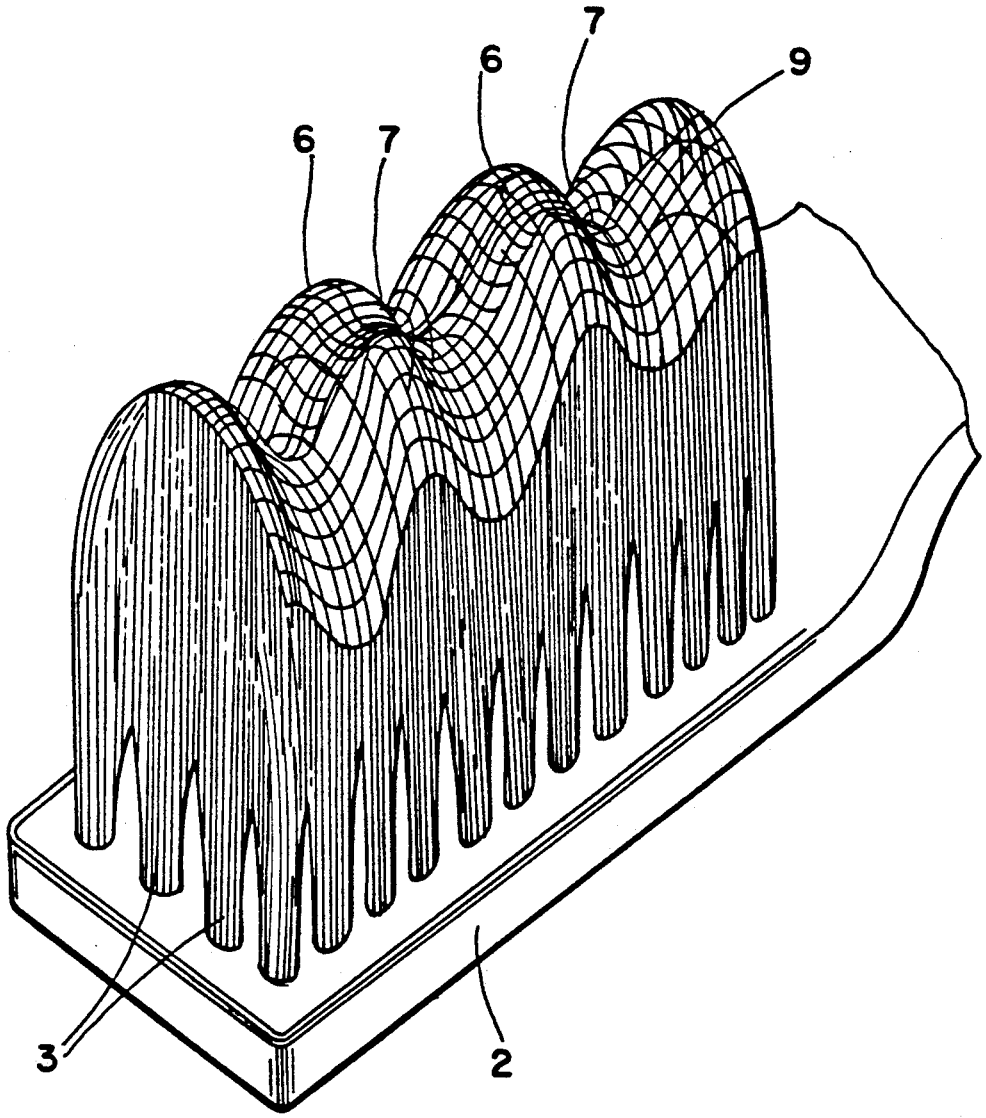
FIG. 6 is a second perspective view, not to scale, concentrating on the bristle head and showing another embodiment of a preferred layout of the contours of its bristle head face by using a cartesian coordinate plot in three dimensions to show the approximate curviture that the bristle head face follows.

Turning now to FIG. 6, there is shown another perspective view of an alternative embodiment of the bristle head face, but a cartesian coordinate graph in three dimensions has been superimposed on the bristle ends to show more graphically the nature of the curvitures in the invention. Although not to scale, the cartesian graph shows the novel way in which the curves of the bristle ends form hill-like convexities 6 and valley or saddle-like hyperbolic concavities, that are free of planar surfaces or points.

At FIG. 7 is shown an additional feature of an especially preferred embodiment of the invention. On the neck 8 that connects handle 1 to head 2, are a plurality of helical screw threads 13. This is shown in enlarged detail in FIG. 8. When a user grasps the handle of this embodiment of the invention as shown at FIG. 9, the user now has the means available to them of having the bristles of the toothbrush move in not only a left-and-right motion, or an up-and-down motion 15, but by placing thumb and index finger on the screw threads 13 and reciprocally twirling the tooth brush around direction of axial rotation 14, can now get the bristles to move diagonally along direction 16. A complete cycle of twirling the toothbrush in this fashion would take the bristles back and forth through an arc of approximately 240°. This in turn means that whatever pitch is selected for the helical threads, when multiplied by a factor of $\frac{2}{3}$, will determine the distance of axial travel of the bristles in the first part of a cycle. Since the two components of motion are simultaneously arctuate and axial, the combined effect is for the bristles to travel through a helical arc 17. The number of threads is not critical and can be any number that accomodate the length of the neck 8, give the desired pitch and give the desired hand feel. Thus, the invention is not to be limited by the number of threads illustrated in FIGS. 7, 8 and 9. Likewise, the height of the threads is not critical and can be varied to get the desired hand feel. the threads are integral with the material of the neck, and are easily formed by conventional molding processes well known to those of ordinary skill in the art of molding thermoplastics.

While the invention has been described and illustrated with reference to certain preparative embodiments thereof, those skilled in the art will appreciate that various changes, modifications and substitutions can be made therein without departing from the spirit and scope of the invention. It is intended, therefore, that the invention be limited only by the scope of the claims which follow, and that such claims be interpreted as broadly as is reasonable.

What is claimed is:

1. A toothbrush having an elongated handle, an integral brush head and a neck connecting said handle to said brush head, said head, neck and handle all being coaxial, said brush head having a longitudinal and a transverse axis with respect to said handle, and which brush head anchors a plurality of bristle tufts having free ends spaced from the head, comprising:

(a) a plurality of bristles, the free ends of said bristles disposed so as to form a bristle face defining alternating series of first and second substantially arctuate curves;

(b) said first curves being substantially convexly arctuate in the longitudinal and transverse axes of said brush head;

(c) said second curves being substantially concavely arctuate in the longitudinal axis of said brush head and substantially convexly arctuate in the transverse axis of said brush head;

(d) said first and second curves defining a regulator and repeating pattern having substantially equal heights and substantially equal depths; and (e) said neck being substantially cylindrical, and said neck furthermore being substantially narrower in dimension than said handle and said brush head, and having on its surface means for enabling a user of said toothbrush to obtain bristle face motion along a line diagonal with respect to said longitudinal axis, said means comprising a plurality of helically wound threads of predetermined thread height and predetermined pitch, which threads are substantially the same radial distance from said longitudinal axis.

2. A toothbrush having an elongated handle, an integral brush head and a neck connecting said handle to said brush head, said head, neck and handle all being coaxial, said brush head having a longitudinal and a transverse axis with respect to said handle, and which brush head anchors a plurality of bristle tufts having free ends spaced from the head, comprising:

(a) a plurality of substantially parallel tufts of bristles, said tufts of varying predetermined heights juxtaposed in close proximity to each other, the tips of said bristles disposed so as to form a bristle face defining alternating series of first and second substantially arctuate curves;

(b) said first curves being substantially convexly arctuate in the longitudinal and transverse axes of said brush head;

(c) said second curves being substantially concavely arctuate in the longitudinal axis of said brush head and substantially convexly arctuate in the transverse axis of said brush head;

(d) said handle fixedly attached via said neck to, and axially rotated with respect to the longitudinal axis of, said brush head;

(e) said first and second curves defining a regular and repeating pattern having substantially equal heights and substantially equal depths; and (f) said neck being substantially cylindrical, and said neck furthermore heating substantially narrower in dimension than said handle and said brush head, said neck having on its surface a plurality of helically wound threads of predetermined thread height and predetermined pitch and which threads are of substantially the same radial distance from said longitudinal axis and which threads comprise means for enabling a user of said toothbrush to obtain bristle face motion along a line diagonal with respect to said longitudinal axis by twirling said neck between a thumb and index finger.

* * * * *